US011028531B2

(12) United States Patent
Spruell et al.

(10) Patent No.: US 11,028,531 B2
(45) Date of Patent: Jun. 8, 2021

(54) FLAME RESISTANT AND CHEMICAL PROTECTIVE TEXTILE MATERIAL

(71) Applicant: Milliken & Company, Spartanburg, SC (US)

(72) Inventors: Jason M. Spruell, Blountville, TN (US); Warren W. Gerhardt, Spartanburg, SC (US); Stephen D. Lucas, Boiling Springs, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 15/343,835

(22) Filed: Nov. 4, 2016

(65) Prior Publication Data

US 2017/0130395 A1 May 11, 2017

Related U.S. Application Data

(60) Provisional application No. 62/253,108, filed on Nov. 9, 2015.

(51) Int. Cl.

| | |
|---|---|
| ***D06M 15/643*** | (2006.01) |
| ***D06M 15/277*** | (2006.01) |
| ***D06M 13/395*** | (2006.01) |
| ***D06M 15/576*** | (2006.01) |
| *D06M 101/36* | (2006.01) |
| *D06M 101/40* | (2006.01) |

(52) U.S. Cl.

CPC ..... *D06M 15/6436* (2013.01); *D06M 13/395* (2013.01); *D06M 15/277* (2013.01); *D06M 15/576* (2013.01); *D06M 2101/36* (2013.01); *D06M 2101/40* (2013.01); *D06M 2200/10* (2013.01); *D06M 2200/30* (2013.01)

(58) Field of Classification Search

CPC ..... D06M 13/395; D06M 15/227; D06M 15/6436; D06M 2101/36

See application file for complete search history.

(56) References Cited

U.S. PATENT DOCUMENTS

| | | | | |
|---|---|---|---|---|
| 4,661,577 | A * | 4/1987 | Jo Lane | D06M 15/6436 106/18.12 |
| 4,958,015 | A | 9/1990 | Zemel et al. | |
| 5,806,155 | A | 9/1998 | Malaney et al. | |
| 6,546,605 | B1 | 4/2003 | Emery et al. | |
| 6,818,253 | B2 | 11/2004 | Kimbrell | |
| 7,055,227 | B2 | 6/2006 | Love et al. | |
| 7,132,131 | B2 | 11/2006 | Bottger et al. | |
| 7,168,140 | B2 | 1/2007 | McKee et al. | |
| 7,901,733 | B2 | 3/2011 | Klutz et al. | |
| 8,156,576 | B1 | 4/2012 | Terrell | |
| 8,359,675 | B2 | 1/2013 | Terrell | |
| 8,793,814 | B1 * | 8/2014 | Dilanni | D02G 3/047 2/272 |
| 8,819,866 | B2 | 9/2014 | Underwood et al. | |
| 2005/0255771 | A1 | 11/2005 | Chetty et al. | |
| 2010/0249312 | A1 * | 9/2010 | Jin | C08F 214/18 524/505 |
| 2010/0323179 | A1 * | 12/2010 | Kim | D04H 1/4342 442/334 |
| 2011/0092119 | A1 * | 4/2011 | Oliver | D06M 13/422 442/143 |
| 2011/0275263 | A1 | 11/2011 | Li et al. | |
| 2014/0378569 | A1 | 12/2014 | Abusleme et al. | |

FOREIGN PATENT DOCUMENTS

| | | | |
|---|---|---|---|
| WO | WO 2011/101857 A2 | 8/2011 | |
| WO | WO-2013087497 A1 * | 6/2013 | C08G 18/7621 |

OTHER PUBLICATIONS

Technical Guide for NOMEX Brand Fiber (Year: 2001).*

Complete Textile Glossary, Celanese Acetate, 2001, definitions of "plain weave" and "twill weave" and illustrations thereof. (Year: 2001).*

PCT/US2016/060550 International Search Report, filed Nov. 4, 2016, 4 pages.

PCT/US2016/060550 Written Opinion, filed Nov. 4, 2016, 8 pages.

* cited by examiner

*Primary Examiner* — Jeremy R Pierce

(74) *Attorney, Agent, or Firm* — Cheryl Brickey

(57) ABSTRACT

A treated textile material comprises a textile substrate and a finish on the yarns making up the textile substrate. The yarns of the textile substrate comprise inherent flame resistant fibers. The finish comprises a fluorochemical repellent. The treated textile material exhibits improved resistance to chemical splashes and spills, such as those encountered in institutional and commercial laboratory settings.

8 Claims, No Drawings

FLAME RESISTANT AND CHEMICAL PROTECTIVE TEXTILE MATERIAL

CROSS REFERENCE TO RELATED APPLICATIONS

This application claims, pursuant to 35 U.S.C. § 119(e)(1), priority to and the benefit of the filing date of U.S. Patent Application No. 62/253,108 filed on Nov. 9, 2015 which application is hereby incorporated by reference in its entirety.

TECHNICAL FIELD

This invention relates to fabrics that are flame resistant and provide protection from chemical splashes and spills.

BACKGROUND

In response to tragic, fire-related incidents, many laboratories (and the institutions governing those laboratories) have begun to require laboratory workers to wear flame resistant outerwear (e.g., laboratory coats) while working in the laboratory. This flame resistant outerwear typically is made from inherent flame resistant fibers, such as aramid fibers. As is known to those in the art, fabrics principally made from inherent flame resistant fibers tend to be relatively uncomfortable to wear due to the nature of the manufactured aramid fibers. Accordingly, in order to increase wearer comfort and promote compliance with the requirement to wear such outerwear, these articles of outerwear typically are constructed using lightweight fabrics having a relatively open weave. While these lightweight, open weave fabrics are capable of providing satisfactory flame resistant, the open weave does not provide acceptable levels of protection from the chemical splashes and spills that one is likely to encounter in a laboratory setting.

A need therefore remains for textile materials (e.g., fabrics) that are flame resistant and comfortable to wear and provide high levels of protection from chemical splashes and spills. The textile materials described in this application seek to satisfy this continued need.

BRIEF SUMMARY OF THE INVENTION

In a first embodiment, the invention provides a treated textile material comprising: (a) a textile substrate having a first surface, the textile substrate comprising a plurality of first yarns and a plurality of second yarns, the plurality of first yarns being disposed in a first direction in the textile substrate, the plurality of second yarns being disposed in a second direction perpendicular to the first direction, the plurality of first yarns and the plurality of second yarns being interwoven, the first yarns and second yarns each comprising about 50 wt. % or more of staple fibers selected from the group consisting of inherent flame resistant fibers, the textile substrate having an areal density of about 150 g/m$^2$ or more and an optical transparency of about 10% or less; and (b) a finish disposed on the first yarns and the second yarns, the finish comprising a fluorochemical repellent, the fluorochemical repellent being present on the textile material in an amount of about 0.05 grams of fluorochemical per gram of the textile substrate.

DETAILED DESCRIPTION OF THE INVENTION

The following definitions are provided to define several of the terms used throughout this application.

As used herein, the term "alkanediyl groups" refers to divalent functional groups derived from alkanes by removal of two hydrogen atoms from the alkane. These hydrogen atoms can be removed from the same carbon atom on the alkane (as in ethane-1,1-diyl) or from different carbon atoms (as in ethane-1,2-diyl).

As used herein, the term "substituted alkanediyl groups" refers to divalent functional groups derived from substituted alkanes by removal of two hydrogen atoms from the alkane. These hydrogen atoms can be removed from the same carbon atom on the substituted alkane (as in 2-fluoroethane-1,1-diyl) or from different carbon atoms (as in 1-fluoroethane-1,2-diyl). In this definition, the term "substituted alkanes" refers to compounds derived from acyclic unbranched and branched hydrocarbons in which (1) one or more of the hydrogen atoms of the hydrocarbon is replaced with a non-hydrogen atom (e.g., a halogen atom) or a non-alkyl functional group (e.g., a hydroxy group, aryl group, or heteroaryl group) and/or (2) the carbon-carbon chain of the hydrocarbon is interrupted by an oxygen atom (as in an ether), a nitrogen atom (as in an amine), or a sulfur atom (as in a sulfide).

As used herein, the term "cycloalkanediyl groups" refers to divalent functional groups derived from cycloalkanes (monocyclic and polycyclic) by removal of two hydrogen atoms from the cycloalkane. These hydrogen atoms can be removed from the same carbon atom on the cycloalkane or from different carbon atoms.

As used herein, the term "substituted cycloalkanediyl groups" refers to divalent functional groups derived from substituted cycloalkanes by removal of two hydrogen atoms from the cycloalkane. In this definition, the term "substituted cycloalkanes" refers to compounds derived from saturated monocyclic and polycyclic hydrocarbons (with or without side chains) in which (1) one or more of the hydrogen atoms of the hydrocarbon is replaced with a non-hydrogen atom (e.g., a halogen atom) or a non-alkyl functional group (e.g., a hydroxy group, aryl group, or heteroaryl group) and/or (2) the carbon-carbon chain of the hydrocarbon is interrupted by an oxygen atom, a nitrogen atom, or a sulfur atom.

As used herein, the term "arenediyl groups" refers to divalent functional groups derived from arenes (monocyclic and polycyclic aromatic hydrocarbons) by removal of two hydrogen atoms from ring carbon atoms.

As used herein, the term "substituted arenediyl groups" refers to divalent functional groups derived from substituted arenes by removal of two hydrogen atoms from ring carbon atoms. In this definition, the term "substituted arenes" refers to compounds derived from monocyclic and polycyclic aromatic hydrocarbons in which one or more of the hydrogen atoms of the hydrocarbon is replaced with a non-hydrogen atom (e.g., a halogen atom) or a non-alkyl functional group (e.g., a hydroxy group).

In a first embodiment, the invention provides a treated textile material comprising a textile substrate and a finish disposed on the yarns comprising the substrate.

The textile substrate can be any suitable textile substrate, such as a woven or knit textile substrate. Preferably, the textile substrate is a woven substrate comprising a plurality of first yarns disposed in a first direction in the textile substrate and a plurality of second yarns disposed in a second direction perpendicular to the first direction. The plurality of first yarns and the plurality of second yarns are interwoven to provide a woven structure. The first and second yarns can be woven together in any suitable pattern, such as a plain weave, basket weave, twill weave, satin weave, or sateen weave. Suitable plain weaves include, but are not limited to, ripstop weaves produced by incorporating, at regular intervals, extra yarns or reinforcement yarns in the warp, fill, or both the warp and fill of the textile substrate during formation. Suitable twill weaves include both warp-faced and fill-faced twill weaves, such as 2/1, 3/1, 3/2, 4/1, 1/2, 1/3, or 1/4 twill weaves. Preferably, the textile substrate is woven in a plain weave.

The first and second yarns can comprise any suitable fiber or filament or any suitable combination of fibers and/or filaments. Preferably, the first and second yarns are spun yarns comprising a plurality of staple fibers. In such embodiments, the yarn can be made from a single type of staple fiber (e.g., spun yarns formed solely from one type of inherent flame resistant fiber), or the spun yarn can be made from a blend of two or more different types of staple fibers (e.g., spun yarns formed from a blend of inherent flame resistant fibers). Such spun yarns can be formed by any suitable spinning process, such as ring spinning, air-jet spinning, or open-end spinning. In certain embodiments, the yarns are spun using a ring spinning process (i.e., the yarns are ring spun yarns).

The fiber content of the first and second yarns can be the same or different. In other words, the first and second yarns can comprise the same staple fibers or combination of staple fibers, or the first and second yarns can comprise different staple fibers or a different combination of staple fibers. Preferably, the first and second yarns comprise the same staple fibers or combination of staple fibers. In a preferred embodiment, the first yarns and second yarns comprise staple fibers selected from the group consisting of inherent flame resistant fibers. As utilized herein, the term "inherent flame resistant fibers" refers to synthetic fibers which, due to the chemical composition of the material from which they are made, exhibit flame resistance without the need for an additional flame retardant treatment. In such embodiments, the inherent flame resistant fibers can be any suitable inherent flame resistant fibers, such as polyoxadiazole fibers, polysulfonamide fibers, poly(benzimidazole) fibers, poly (phenylenesulfide) fibers, aramid fibers (e.g., meta-aramid fibers and para-aramid fibers), polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, polyamide-imide fibers and combinations, mixtures, or blends thereof. In certain embodiments, the inherent flame resistant fibers are preferably selected from the group consisting of aramid fibers (e.g., meta-aramid fibers and para-aramid fibers) and blends of different aramid fibers. In a preferred embodiment, the first and second yarns comprise a blend of meta-aramid fibers and para-aramid fibers. When both are present in the yarn, the meta-aramid fibers and para-aramid fibers can be present in any suitable ratio or relative amounts. Preferably, since the meta-aramid fibers exhibit better flame resistance, the meta-aramid fibers are present in a larger amount than the para-aramid fibers. For example, the ratio of meta-aramid fibers to para-aramid fibers preferably is about 5:1 or more, about 10:1 or more, about 15:1 or more, or about 18:1 or more. The ratio of meta-aramid fibers to para-aramid fibers preferably is about 30:1 or less, about 25:1 or less, or about 20:1 or less.

The first and second yarns can comprise any suitable amount of flame resistant fibers. Preferably, the first and second yarns each comprise about 50 wt. % or more of staple fibers selected from the group consisting of inherent flame resistant fibers. More preferably, the first and second yarns each comprise about 60 wt. % or more, about 70 wt. % or more, about 80 wt. % or more, or about 90 wt. % or more of staple fibers selected from the group consisting of inherent flame resistant fibers.

The first and second yarns can comprise other fibers in addition to the inherent flame resistant fibers discussed above. In a preferred embodiment, the first and second yarns comprise an antistatic or electrostatic dissipative fiber. Suitable antistatic or electrostatic dissipative fibers include, but are not limited to, carbon fibers, such as P140 antistatic carbon fibers from DuPont. The antistatic or electrostatic dissipative fibers can be present in the fiber blend in any suitable amount. For example, the antistatic or electrostatic dissipative fibers can be present in the first and second yarns in an amount of about 1 wt. % to about 5 wt. % (e.g., about 1 wt. % to about 3 wt. %, or about 2 wt. %). The antistatic fibers have been found to be effective at mitigating electrostatic buildup that can occur in the process of blending the fibers and also imparting antistatic properties to the yarns and textile materials (e.g., fabrics) made from the fiber blend.

In a particularly preferred embodiment, the first and second yarns comprise a blend of meta-aramid fibers, para-aramid fibers, and antistatic fibers. In such an embodiment, the three different fibers can be present in any suitable amount. As is discussed above, the meta-aramid fibers preferably comprise the majority of the blend. For example, the first and second yarns preferably comprise about 50 wt. % to about 95 wt. % meta-aramid fibers, about 2 wt. % to about 45 wt. % para-aramid fibers, and about 1 wt. % to about 5 wt. % antistatic fibers. In a particularly preferred embodiment, the first and second yarns comprise about 93 wt. % meta-aramid fibers, about 5 wt. % para-aramid fibers, and about 2 wt. % antistatic fibers.

The textile substrate can have any suitable areal density. Preferably, the textile substrate exhibits an areal density of about 100 $g/m^2$ or more. More preferably, the textile substrate exhibits an areal density of about 150 $g/m^2$ or more.

As noted above, the treated textile material comprises a finish that is disposed on the first and second yarns. The finish preferably comprises a fluorochemical repellent. The fluorochemical repellent can be any fluorochemical repellent that is capable of imparting sufficient chemical resistance to the treated textile material. Preferably, the fluorochemical repellent is a copolymer comprising perfluorinated acrylate monomers. In one preferred embodiment, the fluorochemical repellent is a copolymer comprising a plurality of moieties selected from the group consisting of moieties of Formula (X) and moieties of Formula (XX) below (X)

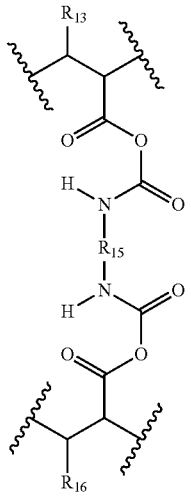

(XX)

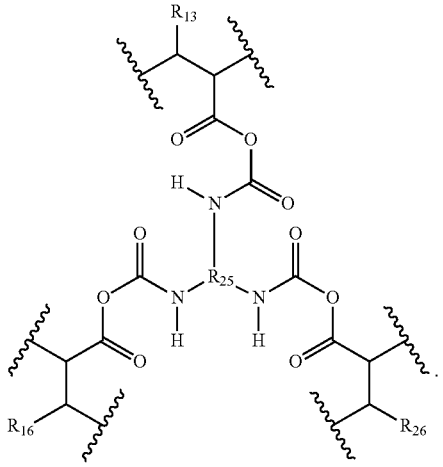

In the structures of Formulae (X) and (XX), $R_{13}$, $R_{16}$, and $R_{26}$ are independently selected from the group consisting of hydrogen and methyl, $R_{15}$ is a divalent linking group, and $R_{25}$ is a trivalent linking group. In the structures of Formulae (X) and (XX) and the structures that follow, the truncated bonds (i.e., the bonds truncated by the wavy line) represent bonds to adjacent moieties or functional groups within the compound. $R_{15}$ can be any suitable divalent linking group. Suitable divalent linking groups include, but are not limited to, alkanediyl groups, substituted alkanediyl groups, cycloalkanediyl groups, substituted cyclolalkanediyl groups, arenediyl groups, substituted arenediyl groups, groups conforming to the formula —$R_{31}$—$R_{32}$—, and groups conforming to the formula —$R_{35}$—$R_{36}$—$R_{37}$—. $R_{31}$ is selected from the group consisting of alkanediyl groups, and $R_{32}$ is selected from the group consisting of substituted cyclolalkanediyl groups. $R_{35}$ and $R_{37}$ are independently selected from the group consisting of cycloalkanediyl groups and arenediyl groups, and $R_{36}$ is selected from the group consisting of alkanediyl groups. Suitable trivalent linking groups include, but are not limited to, groups of Formula (XL) and Formula (L)

(XL)

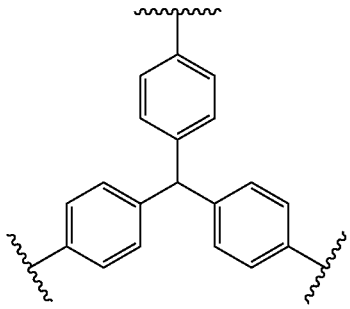

(L)

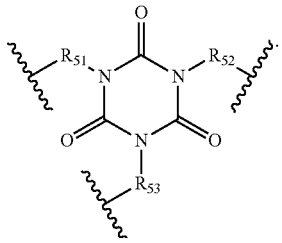

In the structure of Formula (L), $R_{51}$, $R_{52}$, and $R_{53}$ are independently selected from the group consisting of alkanediyl groups, substituted alkanediyl groups, cycloalkanediyl groups, substituted cycloalkanediyl groups, arenediyl groups, and substituted arenediyl groups.

In another preferred embodiment, the fluorochemical repellent is a copolymer comprising a plurality of moieties selected from the group consisting of moieties of Formula (XA) and moieties of Formula (XXA) below (XA)

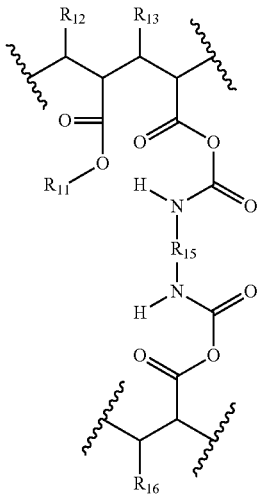

-continued (XXA)

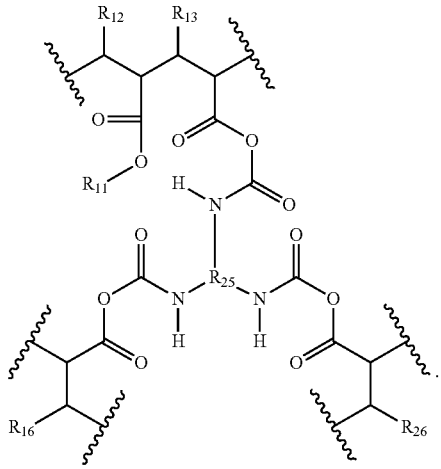

In the structures of Formulae (XA) and (XXA), $R_{11}$ is selected from the group consisting of —$CH_2CH_2CF_2CF_2CF_2CF_3$, —$CH_2CH_2CF_2CF_2CF_2CF_2CF_2CF_3$, and —$CH_2CH_2CF_2CF_2CF_2CF_2CF_2CF_2CF_2CF_3$. $R_{12}$, $R_{13}$, $R_{16}$, and $R_{26}$ are independently selected from the group consisting of hydrogen and methyl. $R_{15}$ is a divalent linking group, and $R_{25}$ is a trivalent linking group. $R_{15}$ and $R_{25}$ can be selected from any of the groups described above in connection with the structures of Formulae (X) and (XX).

The finish can comprise any suitable amount of the fluorochemical repellent. Preferably, the fluorochemical repellent is present on the textile material in an amount of about 0.05 grams or more of fluorochemical repellent per gram of the textile substrate. More preferably, the fluorochemical repellent is present on the textile material in an amount of about 0.075 grams or more of fluorochemical repellent per gram of the textile substrate.

The finish on the textile substrate can comprise other components in addition to the fluorochemical repellent. Preferably, the finish further comprises a compound selected from the group consisting of aminofunctional polysiloxanes, cationic polyolefins, and mixtures thereof. More preferably, the finish further comprises an aminofunctional polysiloxane. Suitable aminofunctional polysiloxanes include, but are not limited to, polysiloxane compounds comprising a plurality of siloxane moieties of Formula (LX)

(LX)

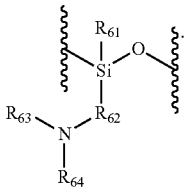

In the structure of Formula (LX), $R_{61}$ is an alkyl group, $R_{62}$ is an alkanediyl group, and $R_{63}$ and $R_{64}$ are independently selected from the group consisting of hydrogen and alkyl groups. In a preferred embodiment, $R_{61}$ is methyl, $R_{62}$ is propane-1,3-diyl, and $R_{63}$ and $R_{64}$ are each hydrogen.

If present in the finish, the aminofunctional polysiloxane or the cationic softener can be present in any suitable amounts. For example, the aminofunctional polysiloxane preferably is present in an amount of about 0.01 grams or more of polysiloxane per gram of the textile substrate. The aminofunctional polysiloxane preferably is present in an amount of about 0.1 grams or less of polysiloxane per gram of the textile substrate.

The treated textile material preferably exhibits a low optical transparency that, in combination with the finish described herein, provides a physical barrier that is resistant to chemical splashes and spills. The optical transparency of the treated textile material can be measured by any suitable means. Preferably, the optical transparency of the treated textile material is measured using optical microscopy and digital image analysis. For example, a sample of the textile material can be backlit on a uniform backlight sample stage that is positioned in the line of sight of an optical microscope equipped with a digital camera. The optical microscope is then focused on an area of the textile material measuring approximately 5 cm by 5 cm (2 in by 2 in) and an image of the area is captured. The resolution of the captured image is at least 1200 dots per inch (dpi). The captured image is then converted to a grayscale image and a threshold filter was applied to flatten the image to a binary pixel map. The threshold filter is set to identify illuminated versus dark pixels using a threshold of 50% of the total intensity. The percentage of illuminated pixels in the image is then reported as the optical transparency of the textile material (lower percentages indicate increasing fabric opacity). Preferably, the treated textile material exhibits an optical transparency of about 10% or less. More preferably, the treated textile material exhibits an optical transparency of about 9% or less, about 8% or less, about 7% or less, or about 6% or less.

The treated textile material can have any suitable air permeability. Preferably, the treated textile material exhibits sufficient air permeability to make garments made from the treated textile material comfortable to wear for extended periods. Such an air permeability increases the likelihood that users will wear the garments and be protected from the fire and chemical spill hazards present in their environment (e.g., a laboratory environment). Preferably, the treated textile material exhibits an air permeability of about 1,400 l/min or more (about 50 $ft^3$/min or more), about 2,100 l/min or more (about 75 $ft^3$/min or more), or about 2,800 $ft^3$/min or more (about 100 $ft^3$/min or more).

As will be understood by those skilled in the art, the combination of high opacity and relatively high air permeability described above can be relatively difficult to achieve. One means to achieve such a combination is through hydraulic napping of the textile substrate using a process such as that described in U.S. Pat. Nos. 6,546,605 and 7,168,140. Accordingly, the treated textile material of the invention can be produced by hydraulic napping of the textile substrate, preferably before the application of the finish to the textile substrate.

The following examples further illustrate the subject matter described above but, of course, should not be construed as in any way limiting the scope thereof.

Example 1

This example demonstrates the production of a treated textile material according to the invention.

A textile substrate was woven using spun yarns having a standard cotton count of 30/2 for both the warp and fill. The yarns were made from a fiber blend containing 95% meta-aramid fibers, 3% para-aramid fibers, and 2% antistatic carbon fibers. The textile substrate was woven in a 1×1 plain weave with 64 ends per inch in the warp and 40 picks per inch in the fill. The resulting woven textile substrate was scoured, mercerized, dyed in a jet, and hydraulically napped. The resulting textile substrate had an areal density of approximately 200 g/m$^2$ (6 oz/yd$^2$).

The textile substrate was then treated with a treatment composition comprising approximately 10 parts by weight of a fluoroacrylic emulsion, approximately 3 parts by weight of a tri-functional blocked isocyanate, approximately 2 parts by weight of a hydrophobic silicone softener, and approximately 85 parts by weight water. The treatment composition was padded onto the textile substrate at a wet pick-up of approximately 60% by weight. The treated textile substrate was then dried for approximately 4 minutes in a convection oven at a temperature of approximately 121° C. (250° F.). Following drying, the fabric was cured in a convection oven at a temperature of approximately 193° C. (380° F.) for approximately 1 minute. The resulting treated textile material will hereinafter be referred to as Sample 1.

Example 2

This example demonstrates the production of a textile material that was treated with a fluorochemical in an amount typical for imparting water repellency to the textile material.

A woven textile substrate was produced using the conditions described in Example 1. The textile substrate was treated with a treatment composition comprising approximately 4 parts by weight of a fluoroacrylic emulsion, approximately 1 part by weight of a tri-functional blocked isocyanate, approximately 2 parts by weight of a hydrophobic silicone softener, and approximately 93 parts by weight water. The treatment composition was padded onto the textile substrate at a wet pick-up of approximately 60% by weight. The treated textile substrate was then dried for approximately 4 minutes in a convection oven at a temperature of approximately 121° C. (250° F.). Following drying, the fabric was cured in a convection oven at a temperature of approximately 193° C. (380° F.) for approximately 1 minute. The resulting treated textile material will hereinafter be referred to as Comparative Sample 1.

Example 3

This example demonstrates the chemical splash and spill resistance of a treated textile material according to the invention.

Sample 1 and Comparative Sample 1 were subjected to several tests to determine the chemical splash and spill resistance of the treated textile materials. These results were compared to those obtained for a similar woven textile material (Comparative Sample 2) that was made in accordance with the general procedure described in Examples 1 and 2 but without treating with a fluorochemical treatment composition. The tests were performed on the textile materials both before and after a series of 20 industrial launderings at a temperature of 65° C. (150° F.).

The spray rating of each textile material was determined in accordance with AATCC Test Method 22. The reported results are an average of three trials.

The chemical drop resistance of each textile material was determined using a modified version of AATCC Test Method 193 and several different solvents. The textile materials were assigned a subjective rating of droplet wettability of A, B, C, or D for each solvent. A rating of "A" indicates that the drop remained on the surface of the textile material and air was visible on the surface of the textile material underlying the drop. A rating of "B" indicates that the drop remained on the surface of the textile material but no air was visible on the surface of the textile material underlying the drop. A rating of "C" indicates that the drop was partially absorbed by the textile material, with approximately half of the drop volume being absorbed by the textile material. A rating of "D" indicates that the drop was completely absorbed by the textile material.

The resistance to breakthrough by a "piranha" solution was determined by stretching a sample of each textile material over the opening of a beaker and securing the sample to keep the textile material taut. A mixture of 3 parts by volume concentrated sulfuric acid and 1 part by volume of 30% hydrogen peroxide (the "piranha" solution) were then mixed and, within 10 seconds of mixing, approximately 10-20 mL of the solution was poured onto the sample. The elapsed time to breakthrough (i.e., the time elapsed from depositing the solution onto the sample to the breaking open of the sample) was then recorded for each sample. The results reported in Table 1 and Table 2 below are an average of three trials.

TABLE 1

Piranha breakthrough time, spray rating, and chemical drop resistance for Sample 1 and Comparative Samples 1 and 2 before laundering.

| | Sample 1 | Comparative Sample 1 | Comparative Sample 2 |
|---|---|---|---|
| Piranha Breakthrough Time (s) | 370 | 92 | 2 |
| Spray Rating | 95 | 95 | 0 |
| Chemical Drop Resistance | | | |
| Water rating | A | A | D |
| 1:1 Ethanol:Water rating | A | A | D |
| Methanol rating | B | C | D |
| Ethanol rating | B | C | D |
| Isopropanol rating | B | C | D |
| Nitrobenzene rating | A | C | D |
| Dimethylsulfoxide rating | A | B | D |
| Dimethylformamide rating | B | C | D |
| Carbon disulfide rating | A | C | D |
| Tetrachloroethylene rating | B | C | D |
| Acetonitrile rating | B | D | D |

TABLE 2

Piranha breakthrough time, spray rating, and chemical drop resistance for Sample 1 and Comparative Samples 1 and 2 after 20 industrial laudnerings.

| | Sample 1 | Comparative Sample 1 | Comparative Sample 2 |
|---|---|---|---|
| Piranha Breakthrough Time (s) | 110 | 45 | 2 |
| Spray Rating | 70 | 70 | 0 |
| Chemical Drop Resistance | | | |
| Water rating | A | A | D |
| 1:1 Ethanol:Water rating | A | B | D |
| Methanol rating | B | C | D |
| Ethanol rating | B | C | D |
| Isopropanol rating | B | C | D |
| Nitrobenzene rating | B | D | D |
| Dimethylsulfoxide rating | A | B | D |
| Dimethylformamide rating | B | C | D |
| Carbon disulfide rating | A | C | D |
| Tetrachloroethylene rating | B | C | D |
| Acetonitrile rating | B | D | D |

As can be seen from the data in Tables 1 and 2, the untreated textile material (Comparative Sample 2) affords essentially no protection against the piranha solution and readily absorbs each of the solvents tested. This means that the untreated textile material would afford little to no protection against chemical splashes and spills. And while Comparative Sample 1 exhibits increased resistance relative to the untreated textile material (i.e., Comparative Sample 2), the textile material still exhibits an undesirably low level of chemical drop resistance because it absorbs some of the solvents tested. This absorption shows that this textile material (i.e., Comparative Sample 1) may not afford a desirable level of protection against chemical splashes and spills.

The treated textile material of the invention (Sample 1) exhibits markedly increased resistance to the piranha solution, increased spray rating, and increased chemical drop resistance compared to Comparative Sample 2. Sample 1 also shows substantial improvements in the piranha solution and chemical drop resistance relative to Comparative Sample 1. As can be seen from the data in Table 2, even though the spray rating and piranha and chemical drop resistance decrease after 20 industrial launderings, the protection afforded by Sample 1 after 20 industrial launderings is still greater than the protection afforded by either of the comparative samples before washing.

These results are believed to demonstrate that the treated textile materials according to the invention can be used to provide levels of chemical splash and spill resistance that would be effective against many of the hazards encountered in a commercial or institutional laboratory environment. Further, the results obtained after repeated launderings show that this chemical splash and spill resistance is maintained at acceptable levels through the repeated industrial launderings that a garment would be subjected to during its typical service life. Lastly, the treated textile materials of the invention will also provide protection against certain fire hazards that may be encountered in commercial or institutional laboratory settings.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A treated textile material comprising:

(a) a textile substrate having a first surface, the textile substrate comprising a plurality of first yarns and a plurality of second yarns, the plurality of first yarns being disposed in a first direction in the textile substrate, the plurality of second yarns being disposed in a second direction perpendicular to the first direction, the plurality of first yarns and the plurality of second yarns being interwoven, the first yarns and second yarns each comprising about 90 wt. % or more of inherent flame resistant staple fibers, the textile substrate having an areal density of about 150 g/m$^2$ or more and an optical transparency of about 10% or less; and (b) a finish disposed on the first yarns and the second yarns, the finish comprising a fluorochemical repellent, the fluorochemical repellent being present on the textile material in an amount of about 0.05 grams or more of fluorochemical repellent per gram of the textile substrate, wherein the treated textile material exhibits an air permeability of about 1,400 l/min or more.

2. The treated textile material of claim 1, wherein the inherent flame resistant staple fibers are aramid fibers.

3. The treated textile material of claim 2, wherein the first yarns and second yarns comprise meta-aramid fibers and para-aramid fibers.

4. The treated textile material of claim 3, wherein the first yarns and second yarns comprise about 93 wt. % meta-aramid fibers, about 5 wt. % para-aramid fibers, and about 2 wt. % antistatic fibers.

5. The treated textile material of claim 1, wherein the fluorochemical repellent is a copolymer comprising perfluorinated acrylate monomers.

6. The treated textile material of claim 5, wherein the copolymer comprises a plurality of moieties selected from the group consisting of moieties of Formula (X) and moieties of Formula (XX)

(X)

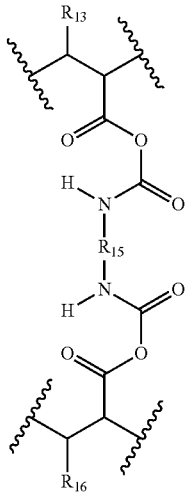

(XX)

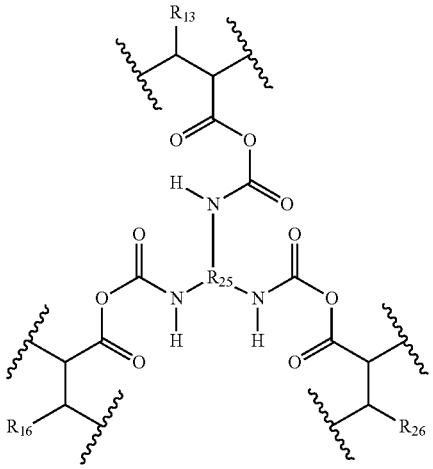

wherein $R_{13}$, $R_{16}$, and $R_{26}$ are independently selected from the group consisting of hydrogen and methyl, $R_{15}$ is a divalent linking group, and $R_{25}$ is a trivalent linking group.

7. The treated textile material of claim 5, wherein the copolymer comprises a plurality of moieties selected from the group consisting of moieties of Formula (XA) and moieties of Formula (XXA)

(XA)

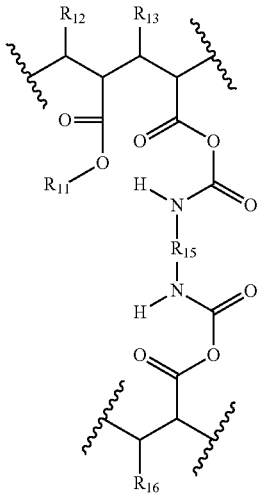

(XXA)

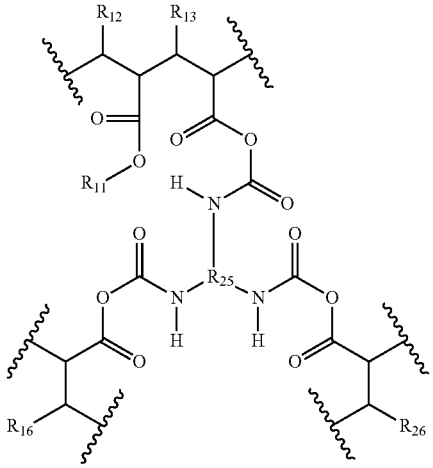

wherein $R_{11}$ is selected from the group consisting of —$CH_2CH_2CF_2CF_2CF_2CF_3$, —$CH_2CH_2CF_2CF_2CF_2CF_2CF_2CF_3$, and —$CH_2CH_2CF_2CF_2CF_2CF_2CF_2CF_2CF_2CF_3$, $R_{12}$, $R_{13}$, $R_{16}$, and $R_{26}$ are independently selected from the group consisting of hydrogen and methyl, $R_{15}$ is a divalent linking group, and $R_{25}$ is a trivalent linking group.

8. The treated textile material of claim 1, wherein the finish further comprises a compound selected from the group consisting of aminofunctional polysiloxanes, cationic polyolefins, and mixtures thereof.

* * * * *